US006000690A

United States Patent [19]

Kudoh

[11] Patent Number: 6,000,690

[45] Date of Patent: Dec. 14, 1999

[54] SHEET FEEDING APPARATUS

[75] Inventor: Taku Kudoh, Sagamihara, Japan

[73] Assignee: Ricoh Company, Ltd., Tokyo, Japan

[21] Appl. No.: 08/837,266

[22] Filed: Apr. 11, 1997

[30] Foreign Application Priority Data

Apr. 11, 1996 [JP] Japan ..... 8-089334

[51] Int. Cl.[6] ..... B65H 3/06; B65H 3/52

[52] U.S. Cl. ..... 271/117; 271/114; 271/115; 271/116; 271/109; 271/119; 271/121

[58] Field of Search ..... 271/10.13, 114, 271/115, 116, 117, 119, 18.2, 109, 121

[56] References Cited

U.S. PATENT DOCUMENTS

| | | | |
|---|---|---|---|
| 4,005,611 | 2/1977 | Jeffries | 280/236 |
| 5,474,287 | 12/1995 | Takahashi | 271/117 |
| 5,550,652 | 8/1996 | Park | 271/117 |

OTHER PUBLICATIONS

Abstract of Japanese Application No. 63–87587.
Abstract of Japanese Application No. 63–86957.
Abstract of Japanese Application No. 63–87588.
Abstract of Japanese Application No. 63–302595.
Abstract of Japanese Application No. 63–300651.
Abstract of Japanese Application No. 55–169569.
Abstract of Japanese Application No. 55–169570.
Abstract of Japanese Application No. 55–170380.

*Primary Examiner*—Donald P. Walsh
*Assistant Examiner*—Daniel Keith Schlak
*Attorney, Agent, or Firm*—Cooper & Dunham LLP

[57] ABSTRACT

A sheet feeding apparatus that can be used in an image reading apparatus or an image recording apparatus to pick-up sheets of paper for one-by-one transfer to an image generating mechanism (e.g., an image reader or a print. head). The sheet feeding apparatus includes sheet pick-up member and a power transmission device that moves the pick-up member from a home position toward a sheet supply portion, from an arbitrary position to an initializing position, and from the initializing position to the home position.

7 Claims, 5 Drawing Sheets

FIG. 5
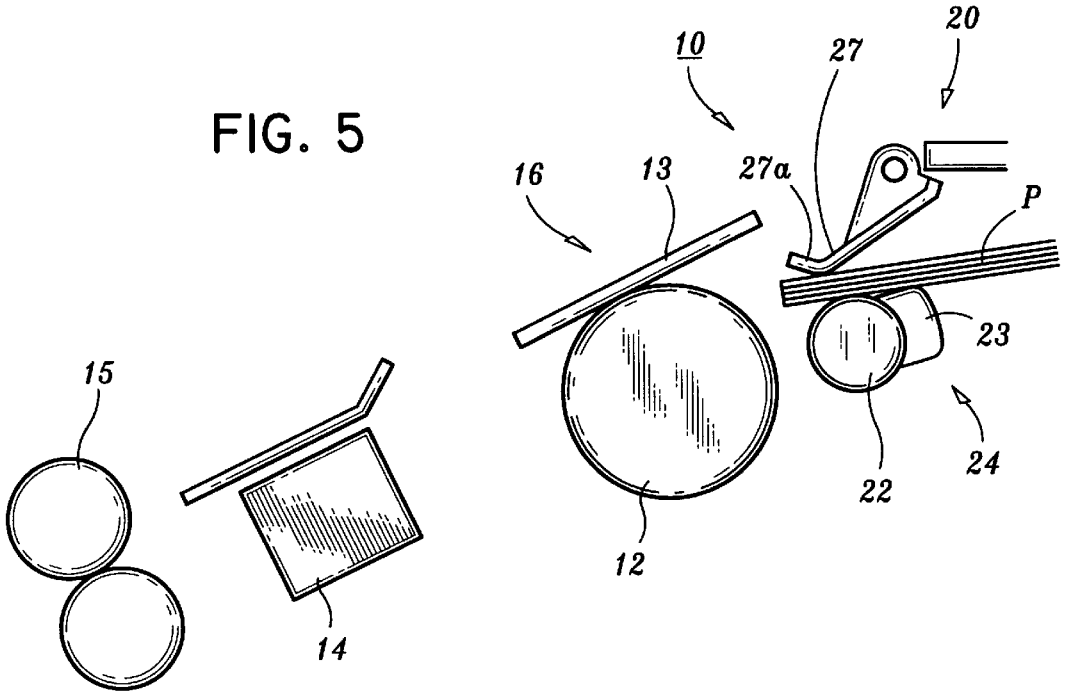
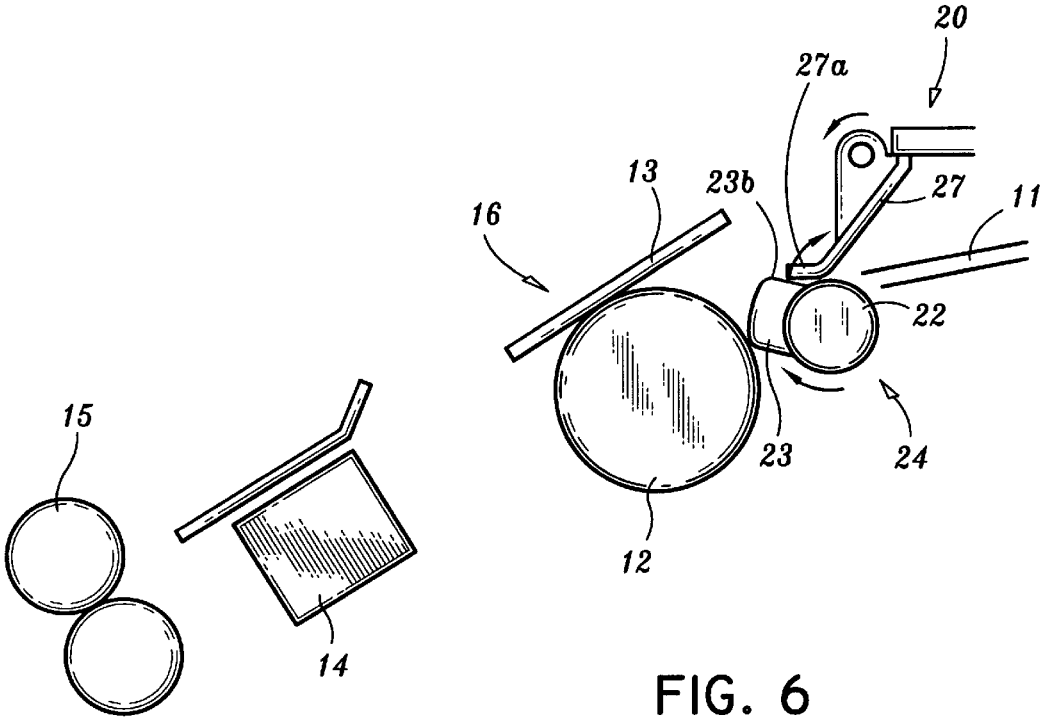
FIG. 6

SHEET FEEDING APPARATUS

BACKGROUND

1. Field of the Invention

The present application relates to sheet feeding apparatus used to supply sheets of paper in image reading or recording apparatus. More particularly, the present application provides a sheet feeding apparatus having an improved sheet pick-up mechanism.

2. Description of the Related Art

Conventional sheet feeding apparatus typically use a sheet pick-up device for picking up sheets of paper from a paper delivery tray and a sheet transfer device for transferring the sheets to an image reader. Some pick-up devices use a cam that rotates to engage a sheet of paper from the bottom of the delivery tray and position an edge of the sheet onto rollers which transfer the sheet to the image reader. In order to ensure that the next sheet of paper is properly picked-up and transferred to the image reader, the sheet feeding apparatus has to know the position of the cam prior to picking-up the sheet. This is achieved by moving the cam to a predefined home position prior to picking-up the sheet. However, the rotational speed of the cam is typically slower than the rotational speed of the rollers so that when the rollers grab the sheet the cam must release the sheet so that: 1) the cam does not retard the speed at which the sheet is fed to the image reader; and 2) the cam is not damaged by the acceleration force created by the rollers. One attempt to avoid these problems is to connect the cam to a clutch so that when the rollers grab the sheet the clutch actuates causing the cam to release the sheet.

Once the clutch actuates to cause the cam to release the sheet, the actual position of the cam is unknown. Thus, to determine the location of the cam, conventional sheet feeding apparatus add sensors and additional structure to the pick-up device to determine the location of the cam.

For example, Japanese Laid-open Publication No. 05-162888, appears to discuss a pick-up device that returns and stops at a home position using a combined cam and spring board mechanism. As a result, the cost of manufacturing such a pick-up device increases the cost of manufacturing the sheet feeding apparatus.

SUMMARY

The present application provides a sheet feeding apparatus that can be used in an image reading apparatus or an image recording apparatus (image reading/recording apparatus) to pick-up sheets of paper one-by-one and to transfer the sheets to an image generating mechanism (e.g., an image reader or a print head) of the image reading/recording apparatus. The sheet feeding apparatus includes a sheet pick-up portion and a sheet transferring portion.

The sheet pick-up portion of the present application includes a sheet pick-up member configured to pick up sheets from a sheet supply portion and to present the sheets to a sheet transferring portion, a power transmission device coupled to said pick-up member. The power transmission is preferably configured to move the pick-up member: 1) from a home position toward the sheet supply portion to present sheets to the sheet transferring portion; 2) from an arbitrary position which occurs after the sheets are presented to the sheet feeding portion to an initializing position; and 3) from the initializing position to the home position. A sheet hold device associated with the sheet supply portion is configured to define the initializing position. When the pick-up member is moved into engagement with the sheet hold device, movement of the pick-up member is stopped while the power transmission continues to move. At this point the pick-up member is at the initializing position. The sheet hold device may be formed with a tooth edge that engages the pick-up member when the power transmission device moves the pick-up member to the initializing position.

The power transmission device includes a slip gear mechanism that permits the power transmission device to continue moving when the pick-up member engages the sheet hold device. Preferably, the slip gear mechanism includes a pair of gears that slide out of engagement when the pick-up member engages the sheet hold device.

BRIEF DESCRIPTION OF THE DRAWINGS

Preferred embodiments of the invention are described hereinbelow with reference to the drawings wherein:

FIGS. 4–6 illustrate one embodiment for picking-up a sheet of paper using rotational movement of a sheet pick-up member of the sheet feeding apparatus;

DETAILED DESCRIPTION

The present application provides a sheet feeding apparatus used to feed sheets of paper in various image reading/recording apparatus, such as, scanners, facsimile machines, copier machines, printers and the like.

Figure 1:
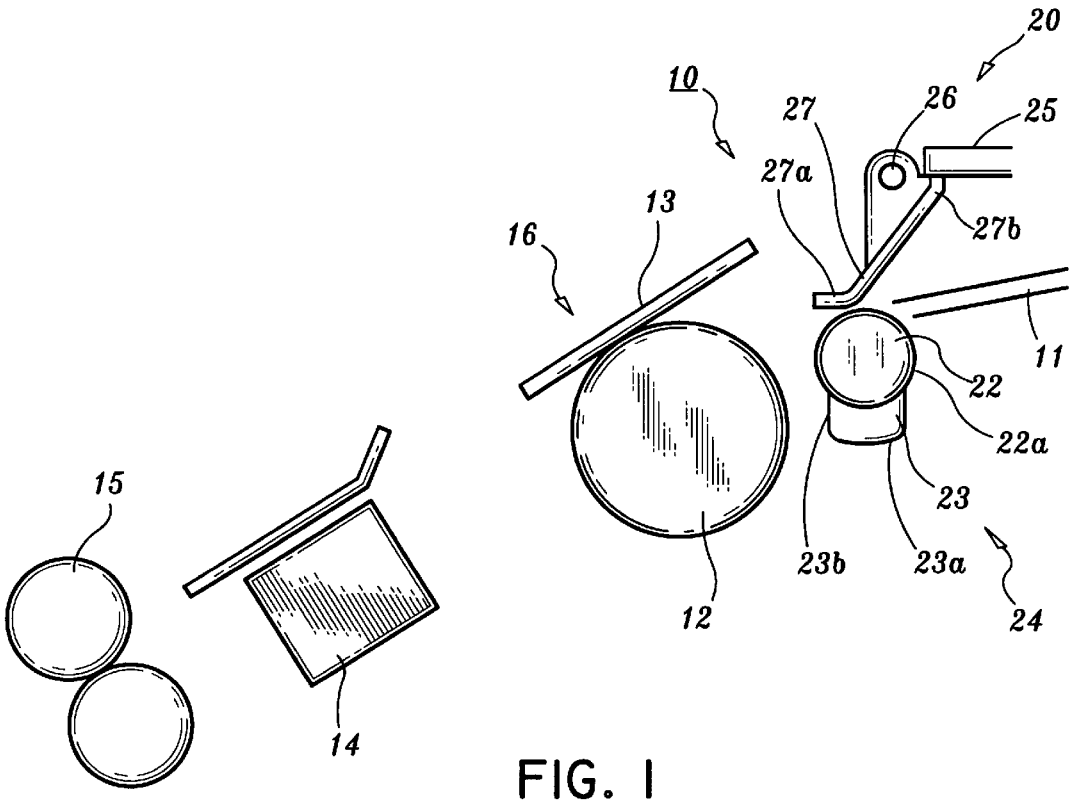
FIG. 1 illustrates a schematic diagram of an image reading/recording apparatus having a sheet feeding apparatus used to feed sheets of paper to an image generating mechanism.

Referring to FIG. 1, a sheet feeding apparatus that can be incorporated into an image reading/recording apparatus is shown. The sheet feeding apparatus 10 includes: 1) a sheet supply portion 20; 2) a sheet pick-up portion 24; and 3) a sheet transferring portion 16. Together these portions supply, pick-up and transfer sheets of paper to an image generating mechanism 14. The sheet supply portion 20 includes a paper delivery tray 11 having an upper cover 25 and sheet holding member 27 pivotally secured to the upper cover via pivot arm 26 which is normally biased toward tray 11. The paper delivery tray 11 provides a paper supply for the sheet feeding apparatus, and the sheet holding member 27 applies downward pressure against the paper supply in the tray so that the sheet pick-up and sheet transferring portion can properly pick-up sheets of paper from the tray and separate the sheets for one-by-one transfer to the image generating mechanism.

The sheet transferring portion 16 of the image reading/recording apparatus includes a feed roller 12 and a sheet separating pad 13 that are configured to separate sheets of paper picked-up from the tray 11 one-by-one by friction of the feed roller 12 and the pad 13 and to transfer the sheet to the image generating mechanism 14.

Figure 2:
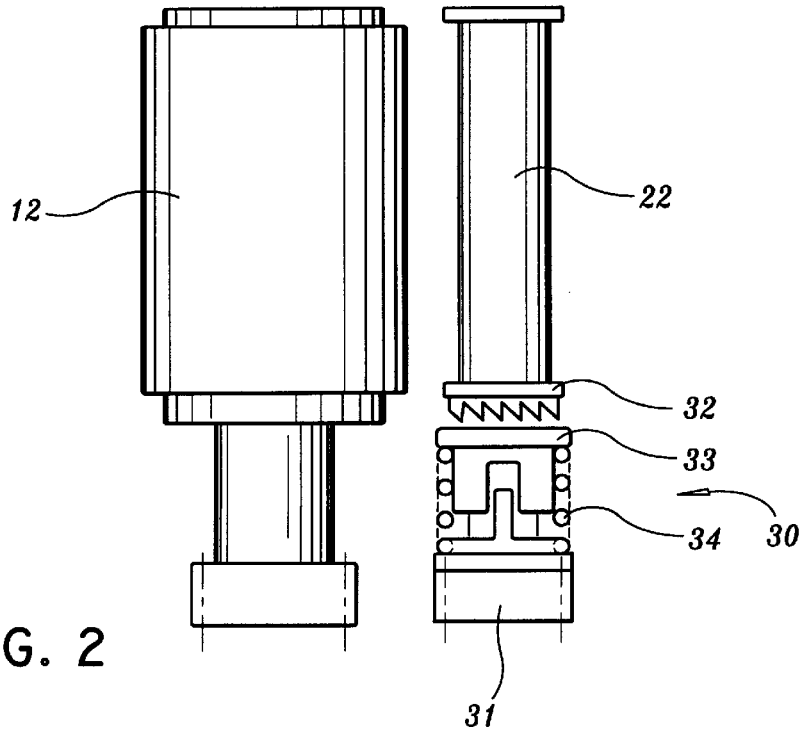
FIG. 2 illustrates a power transmission device with engaged gears in a slip gear configuration for the sheet feeding apparatus of FIG. 1.

Referring to FIGS. 1 and 2, in one embodiment the sheet pick-up portion 24 includes power transmission device 12, shaft 22 and sheet pick-up member 23. As seen in FIG. 2, the power transmission device 12 has at least a portion which is connected to or formed into the shaft 22. The power transmission device is used to translate movement of, for example, a motor (not shown) to movement of the shaft. The power transmission device is also configured to release so that movement of the shaft 22 stops when movement of the pick-up member 23 or shaft 22 is obstructed.

The pick-up member 23 may be secured to the shaft 22, or the shaft and pick-up member may be of monolithic construction.

The power transmission device 21 moves shaft 22 so that the sheet pick-up member 23 is moved from a home position when starting a sequence of picking-up sheets from the tray 11. When roller 12 grabs the last sheet for transfer to the image generating mechanism the power transmission device permits the pick-up member to release the sheet so that: 1) the pick-up member does not retard the speed at which the sheet is fed to the image generating mechanism; and 2) the pick-up member is not damaged by the acceleration force created by the roller 12. When the pick-up member releases the sheet the pick-up member moves to an arbitrary position. Thus, to return the pick-up member to the home position the position of the pick-up member has to be determined. To achieve this, the power transmission device also moves the shaft 22 so that the sheet pick-up member 23 moves from the arbitrary position to an initialization position used by the image reading/recording apparatus to determine the location of the pick-up device after the sheets are fed to the sheet transferring portion and prior to returning the pick-up member 23 to the home position.

In the embodiment seen in FIG. 1, shaft 22 is configured to rotate so that the sheet pick-up member 23 rotates from the home position and picks-up sheets of paper at the bottom of the paper supply in tray 11, and presents the sheets to the sheet transferring portion 16. Preferably, the sheet delivery tray 11 has a notch which permits the sheet pick-up member 23 to pass through the tray and engage the paper.

Figure 3:
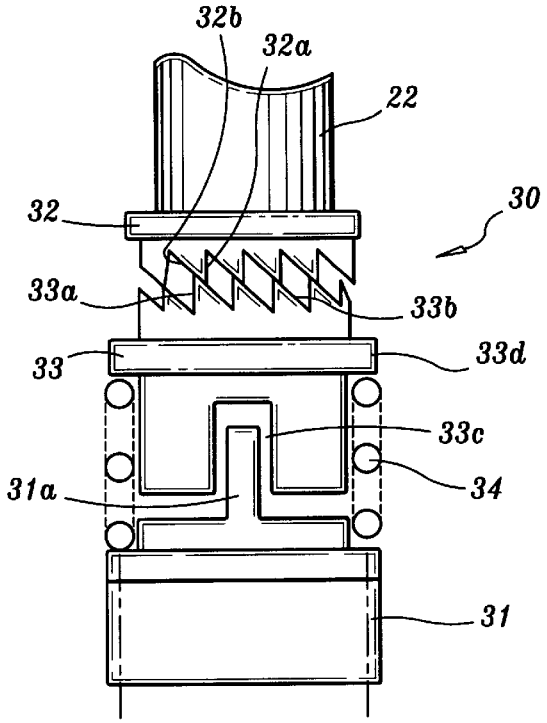
FIG. 3 is a view of the power transmission device of FIG. 2 greatly enlarged.

Referring now to FIGS. 2 and 3, one embodiment of the power transmission device 12 of the present application is shown. In this embodiment, the power transmission device 12 includes a transmission drive member 31, a slip gear mechanism 30, and a biasing member, such as spring 34. The slip gear mechanism 30 includes gears 32 and 33, and the biasing member 34 normally biases gear 33 into engagement with gear 32. The transmission drive member 31 is coupled to gear 33 using a tongue and groove configuration where tongue 31*a* of drive member 31 is fitted into groove 33*c* of gear 33.

Figure 7:
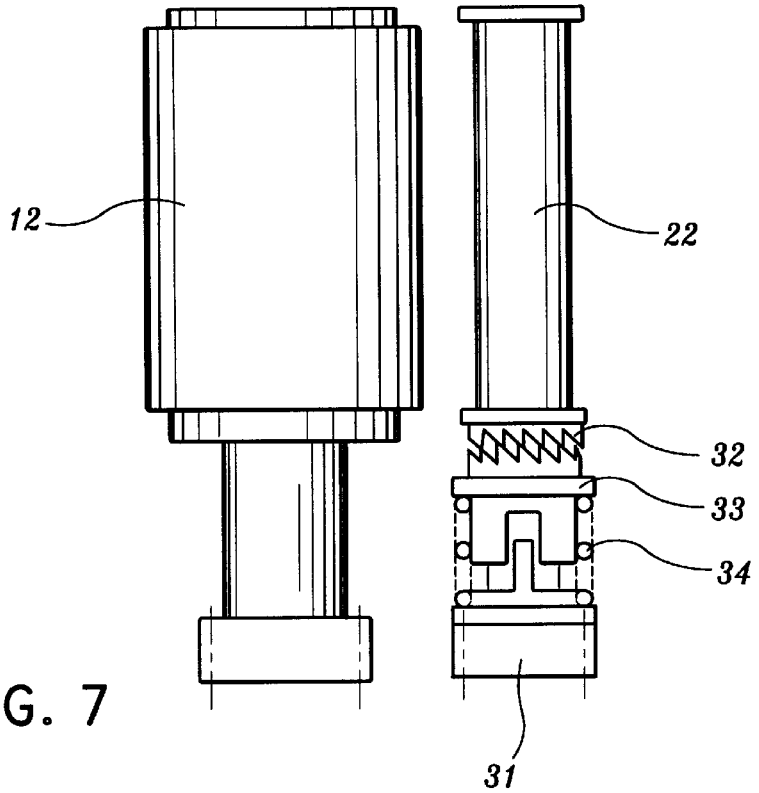
FIG. 7 is a timing diagram for controlling the rotational movement of the sheet pick-up member shown in FIGS. 4–6.

Preferably, the gears 32 and 33 are in an opposing saw-tooth configuration so that surfaces 32*a* and 33*a* engage and surfaces 32*b* and 33*b* engage, as seen in FIG. 3. In this configuration, when the transmission drive member 31 is rotated counter-clockwise the gears 32 and 33 engage each other (seen in FIG. 2) so that counter-clockwise rotational movement of the transmission drive 31 is translated to counter-clockwise rotational movement of the shaft 22. Thus, pick-up member 23 can be rotated from the home position to pick-up sheets of paper in tray 11 and present the sheets to the sheet transferring portion 16. Clockwise rotational movement of the transmission drive member 31 will likewise be translated to clockwise rotational movement of the pick-up member. However, due to the slip gear configuration, if rotational movement of the shaft or pick-up member is obstructed by, for example, sheet pick-up member 23 engaging tip 27*a* of sheet holding member 27, the sloped surfaces of the gears 32 and 33 allow the teeth of the gears to slide along the surfaces and disengage, as seen in FIG. 7. As a result, rotational movement of the shaft 22 and pick-up member 23 are stopped.

An alternative to using gears 32 and 33 in the power transmission device 21 is to use friction plates to translate movement (e.g., rotational movement) of a motor to movement of the shaft 22. A first plate may be mounted to or formed into the shaft and a second plate may be coupled to the biasing member 34. The biasing member 34 biases the second plate into engagement with the first plate with sufficient friction force created between the plates to rotate the shaft 22 but which releases when movement of the pick-up member 23 is obstructed, e.g., when the pick-up member engages the sheet hold device 27. To further increase the breakdown force used to release the plates, the sheet holding device can include a toothed edge as seen in FIG. 9 and discussed below.

As discussed above, after the sheets are transferred to the sheet transferring portion, the location (or position) of the pick-up member 23 has to be determined before it can be returned to the home position. To achieve this, the shaft 22 is rotated in a reverse direction (e.g., clockwise) so that the pick-up member 23 can rotate from the arbitrary position at least one full revolution. When the sheet pick-up member 23 engages the tip 27*a* of the sheet holding device 27 the gears 32 and 33 disengage and the pick-up device is in the initializing position, as described above.

Figure 9:
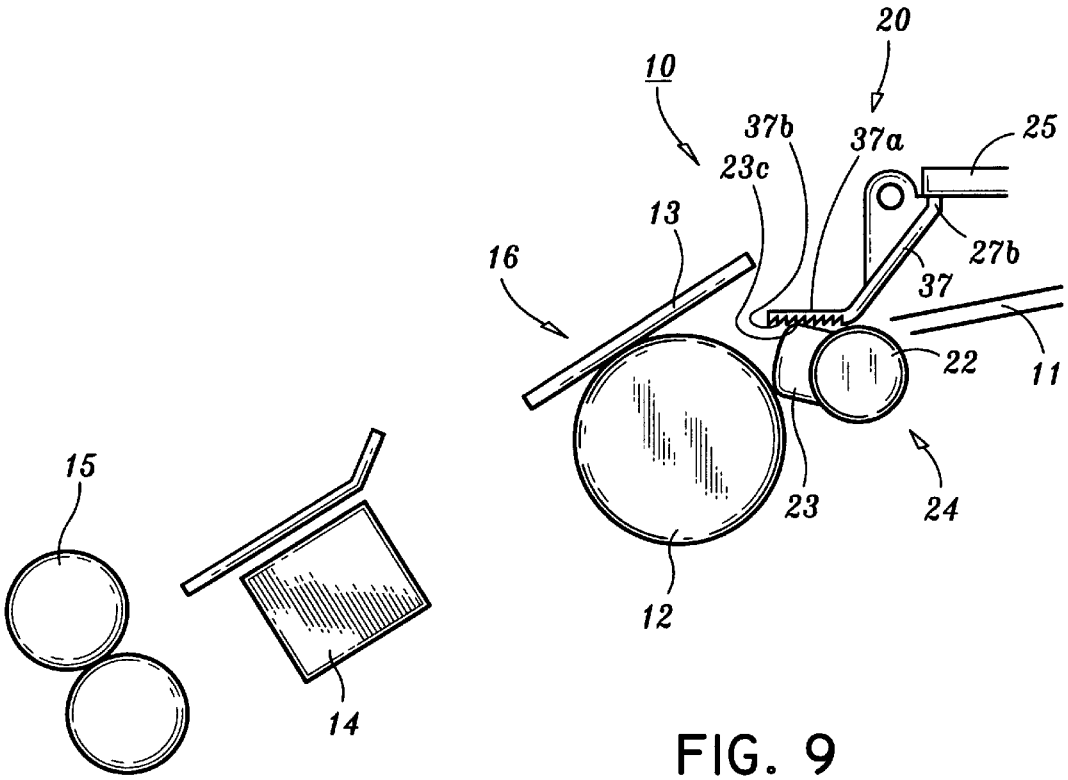
FIG. 9 illustrates an alternative embodiment of a sheet pick-up portion of the present application.

Referring now to FIG. 9, an alternative embodiment of the sheet feeding apparatus is shown. In this embodiment, a sheet hold device 37 is formed with a toothed edge 37*b* that engages the sheet pick-up member 23 when the shaft 22 is rotated clockwise so that the pick-up member 23 is maintained in the initializing position for subsequent return to the home position.

General operation of the image reading/recording apparatus will now be described. Initially, the sheet pick-up member 23 is rotated from the home position toward the sheet supply portion to pick-up sheets of paper (P) from tray 11. The sheets are presented to the sheet transferring portion 16 where they are separated for one-by-one transfer to the image generating mechanism 14.

If the image generating mechanism 14 is, for example, an image reader, the image from the surface of the sheet is read and image reader outputs an analog signal based on the image to electric circuits (not shown) of the image reading/recording apparatus. If the image generating mechanism 14 is, for example, a print head, an image is recorded onto the surface of the sheet.

Thereafter, the sheet is discharged from the image reading/recording apparatus by discharge rollers 15. After the tray 11 is empty, the pick-up member is moved to the initializing position and then returned to the home position.

Figure 4:
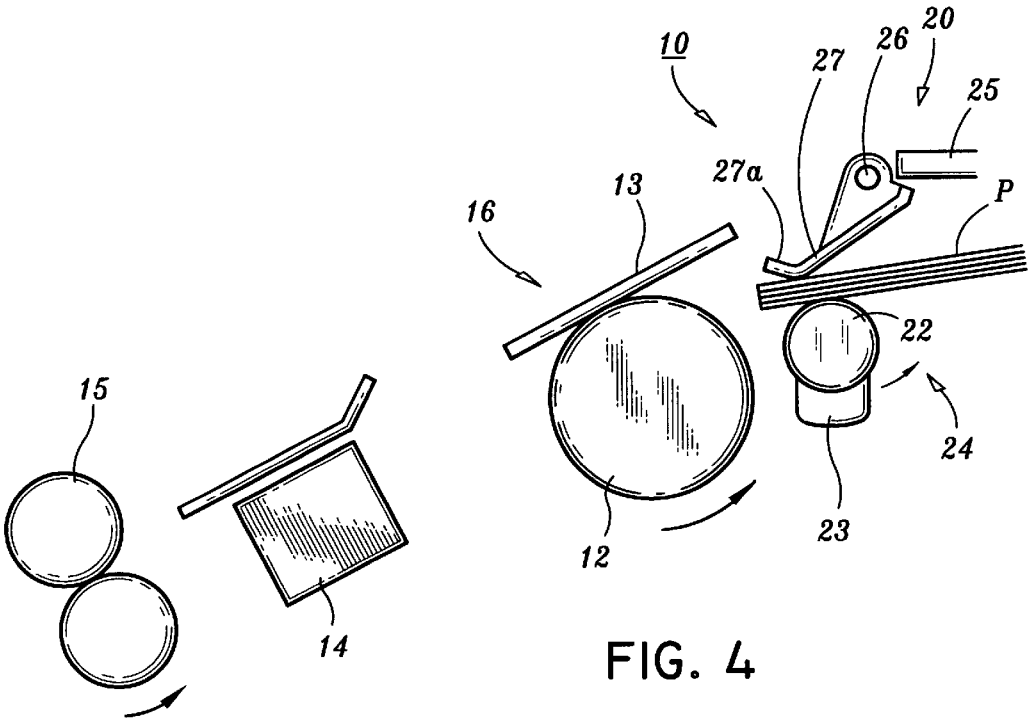

Referring now to FIGS. 4–6, operation of the sheet feeding apparatus will be discussed in detail. Initially, a user activates, for example, a start switch (not shown) on the image reading/recording apparatus to activate the sheet feeding apparatus. This causes the transmission drive member 31 to rotate counterclockwise. As noted above, rotational movement of the drive member 31 is translated to the shaft 22 so that the sheet pick-up member 23 rotates from the home position, seen in FIG. 4, toward the sheets of paper (P) in the sheet delivery tray 11.

When the pick-up member 23 reaches the sheets (seen in FIG. 5), sheets are picked-up by the pick-up member 23 as it passes through the notch in tray 11 and the sheets are presented to the sheet transferring portion 16.

The sheets are then separated by sheet separating pad 13 and feed roller 12 one-by-one and each sheet is transferred to the image generating mechanism 14 for subsequent reading an image from the sheet, or recording an image onto the sheet.

Figure 8:
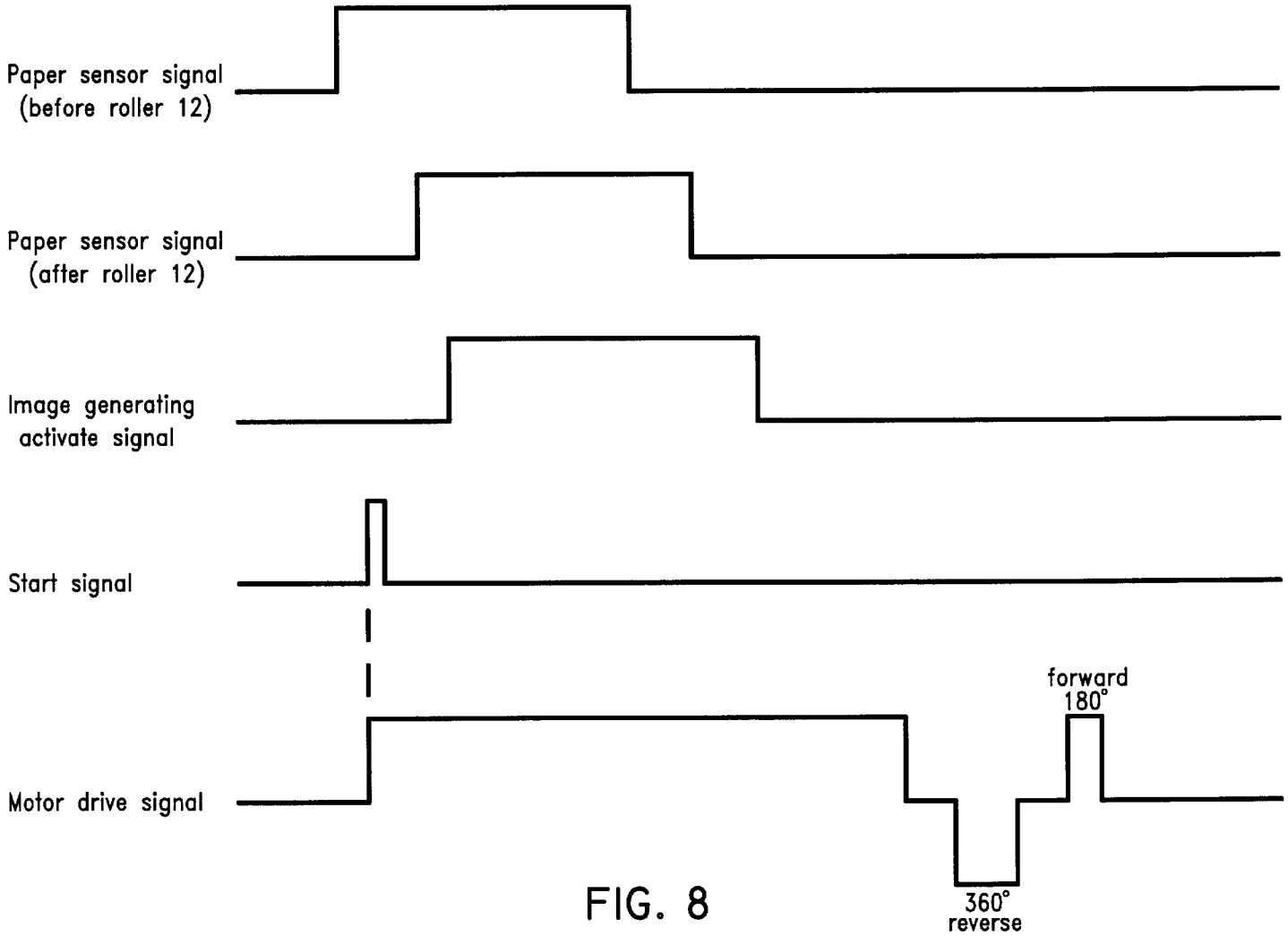
FIG. 8 illustrates a power transmission device with disengaged gears in the slip gear configuration FIG. 2.

This process is repeated until all of the sheets in the document table 11 are discharged. Once all of the sheets have been discharged, the sheet pick-up member 23 is returned to the home position. To return the pick-up member 23 to the home position, the location of the pick-up member is determined. However, as noted above, as sheets are transferred to the sheet transferring portion 16, the roller 12 is rotating at a faster rate than the rotational rate of the pick-up member 23 so that the slip gear mechanism activates so that the pick-up member releases the sheet. As a result, the position of the pick-up member is not known and is identified as the arbitrary position. To determine the position of the pick-up member, the transmission drive member 31 is rotated in a reverse direction so that shaft 22 and pick-up member 23 rotate clockwise. In order to determine the position of the pick-up member 23, the transmission drive member 31 is rotated at least one revolution clockwise so that the pick-up member 23 engages the tip 27*a* of the sheet hold device 27. When the pick-up member engages the tip 27*a*, rotation of the pick-up member 23 and the shaft 22 is obstructed. As a result, the gears 32 and 33 of the slip gear mechanism 30 disengage (seen in FIG. 7) and the shaft 22 stops rotating. At this point the pick-up member 23 is in the initializing position which then allows the reading/recording device to return the pick-up member to the home position. By knowing the location of the pick-up member 23 after one rotation in the clockwise direction, the pick-up member 23 may be returned to the home position by rotating the power transmission device counter-clockwise for a predetermined period so that the pick-up member moves from the initializing position to the home position. FIG. 8 illustrates a timing diagram for controlling the movement of the power transmission device after the start button has been activated.

It will be understood that various modifications can be made to the embodiments of the present invention herein without departing from the spirit and scope thereof. For example, various types of pick-up members can be used in the sheet feeding apparatus of the present application, and configurations for the sheet transferring portion may be utilized. Further, various image generating mechanisms in addition to those identified in the above detailed description may be employed. Therefore, the above description should not be construed as limiting the invention, but merely as preferred embodiments thereof. Those skilled in the art will envision other modifications within the scope and spirit of the invention as defined by the claims appended hereto.

What is claimed is:

1. A sheet feeding apparatus, comprising:

a sheet pick-up member configured to pick up sheets from a sheet supply portion and to present the sheets to a sheet transferring portion;

a power transmission device coupled to said pick-up member and configured to move said pick-up member at least from a home position toward said sheet supply portion to present sheets to said sheet transferring portion, and from an arbitrary position which occurs after the sheets are presented to the sheet feeding portion to an initializing position, and from said initializing position to said home position; and a sheet hold device associated with said sheet supply portion and configured to define said initializing position such that when said pick-up member is moved into engagement with said sheet hold device movement of said pick-up member is stopped while said power transmission continues to move and said pick-up member is at said initializing position.

2. The sheet feeding apparatus according to claim 1, wherein said power transmission device comprises a slip gear mechanism that permits said power transmission device to continue moving when said pick-up member engages said sheet hold device.

3. The sheet feeding apparatus according to claim 2, wherein said slip gear mechanism comprises a pair of toothed gears that slide out of engagement when said pick-up member engages said sheet hold device.

4. The sheet feeding apparatus according to claim 3, wherein said power transmission device is coupled to said pick-up member by a shaft having one of said pair of toothed gears.

5. The sheet feeding apparatus according to claim 4, wherein said pick-up member is connected to said shaft.

6. The sheet feeding apparatus according to claim 4, wherein said pick-up member and said shaft are monolithically formed.

7. The sheet feeding apparatus according to claim 1, wherein said sheet hold device is formed with a tooth edge that engages the pick-up member when said power transmission device moves said pick-up member to said initializing position.

* * * * *